US006203272B1

(12) United States Patent
Walsham

(10) Patent No.: US 6,203,272 B1
(45) Date of Patent: Mar. 20, 2001

(54) VARIABLE GEOMETRY TURBINE

(75) Inventor: Brian E. Walsham, Huddersfield (GB)

(73) Assignee: Holset Engineering Company, Ltd., Huddersfield (GB)

( * ) Notice: Subject to any disclaimer, the term of this patent is extended or adjusted under 35 U.S.C. 154(b) by 0 days.

(21) Appl. No.: 09/284,042

(22) PCT Filed: Sep. 25, 1997

(86) PCT No.: PCT/GB97/02617

§ 371 Date: Oct. 26, 1999

§ 102(e) Date: Oct. 26, 1999

(87) PCT Pub. No.: WO98/14691

PCT Pub. Date: Apr. 9, 1998

(30) Foreign Application Priority Data

Mar. 10, 1997 (GB) ..... 9620596

(51) Int. Cl.[7] ..... F01D 17/14
(52) U.S. Cl. ..... 415/158
(58) Field of Search ..... 60/602; 415/158

(56) References Cited

U.S. PATENT DOCUMENTS 4,527,949 * 7/1985 Kirtland .
4,611,969 * 9/1986 Zinsmeyer .
4,779,423 * 10/1988 Szczupak .
5,522,697 * 6/1996 Parker et al. ..... 415/158
5,868,552 * 2/1999 McKean et al. ..... 415/158

FOREIGN PATENT DOCUMENTS 59-040098 * 3/1984 (JP) .

* cited by examiner

*Primary Examiner*—Michael Koczo
(74) *Attorney, Agent, or Firm*—Gary M. Gron

(57) ABSTRACT

A variable geometry turbocharger for an internal combustion engine in which the position of the nozzle ring is adjusted to control the width of an exhaust gas inlet passage. A chamber is defined behind the nozzle ring which communicates with the inlet passage and the pressure within that chamber is monitored. The monitored pressure is used as a control parameter for a mechanism which displaces the nozzle ring. Positioning a sensor in the recess behind the nozzle ring protects the sensor from the relatively more extreme environment within the engine exhaust gas manifold.

2 Claims, 3 Drawing Sheets

VARIABLE GEOMETRY TURBINE

TECHNICAL FIELD

The present invention relates to a variable geometry turbine for use with an internal combustion engine.

BACKGROUND OF INVENTION

Turbines generally comprise a turbine wheel mounted in a turbine chamber, an inlet passage extending radially inwards towards the turbine chamber, an inlet chamber arranged around the radially outer end of the inlet passage, and an outlet passage extending axially from the turbine chamber. The passages and chamber communicate such that pressurized gas admitted to the inlet chamber flows through the inlet passage to the outlet passage via the turbine chamber, thereby driving the turbine wheel. In the case of a turbocharger for an internal combustion engine, the turbine wheel drives a shaft which in turn drives a rotary compressor.

In one known variable geometry turbine, one wall of the inlet passage is effectively displaceable relative to the facing wall of the inlet passage so as to enable the effective width of the inlet passage to be adjusted. The moveable wall is defined by an annular member generally referred to as a nozzle ring which term will be used below. The position of the nozzle ring is controlled by an actuator mechanism which may be for example hydraulic or pneumatic, the actuation mechanism responding to a control input that is generated in dependence upon various engine operating parameters. One parameter which is used to control the nozzle ring actuating mechanism is the exhaust manifold pressure of the engine to which the turbine is connected. It is useful to be able to arrange for the turbine to respond to exhaust gas pressure fluctuations for example during rapid acceleration, sudden load application, or during engine braking.

It is conventional test-bed practice to measure engine exhaust manifold pressure directly from the engine manifold, and to produce a mean pressure value by smoothing out the pressure fluctuations which result from engine operation. The techniques used are not however suitable for day-to-day use in commercial applications either in terms of cost or sensor durability. Accordingly, although it is known to be desirable to control the variable geometry mechanism of a turbine in dependence upon engine exhaust pressure, in practice this has not been achieved in normal commercial applications.

U.S. Pat. No. 5,522,697 describes a variable geometry turbine in which the turbine comprises a housing, an annular exhaust gas inlet passage defined between walls of the housing, a nozzle ring which is displaceable across the inlet passage, and a control means for controlling the displacement of the nozzle ring in response to variations in sensed parameters. The nozzle ring extends into an annular recess defined by the housing in one side wall of the inlet passage such that a chamber is defined within the recess between the housing and the side of the nozzle ring remote from the inlet passage. The nozzle ring is apertured such that the pressure in the chamber defined between the housing and the nozzle ring is not substantially different from the pressure within the inlet passage. It is indicated in the above U.S. Patent that it is desirable to substantially equalize the pressure within the inlet passage and behind the nozzle ring to minimize the load applied to the nozzle ring displacement mechanism. No suggestion is made however that the pressure within the chamber behind the nozzle ring can be used as a control parameter for the displacement mechanism.

SUMMARY OF THE INVENTION

It is an object of the present invention to obviate or mitigate the problem outlined above with regard to deriving a useful measure of exhaust gas pressure.

According to the present invention, there is provided a variable geometry turbine for an internal combustion engine, the turbine comprising a housing, an annular exhaust gas inlet passage defined between walls of the housing, a nozzle ring which is displaceable across the inlet passage, and a control means for controlling the displacement of the nozzle ring in response to variations in at least one sensed parameter, the nozzle ring extending into an annular recess defined by the housing in one side wall of the inlet passage such that a chamber which communicates with the inlet passage is defined within the recess between the housing and the side of the nozzle ring remote from the inlet passage, wherein a pressure sensor is positioned to sense the pressure within the chamber defined between the housing and the nozzle ring, and the control means is responsive to variations in the sensed pressure.

The nozzle ring may be of U-shaped radial section and have a radial wall facing the inlet passage and two axial flanges extending into the recess from radially opposite edges of the radial wall. Seals may be provided between each of the axial flanges and facing walls of the recess. At least one aperture may be provided in the radial wall to interconnect the inlet passage and the chamber.

SUMMARY OF THE DRAWINGS

An embodiment of the present invention will now be described, by way of example, with reference to the accompanying drawings, in which.

DESCRIPTION OF THE INVENTION

Figure 1:
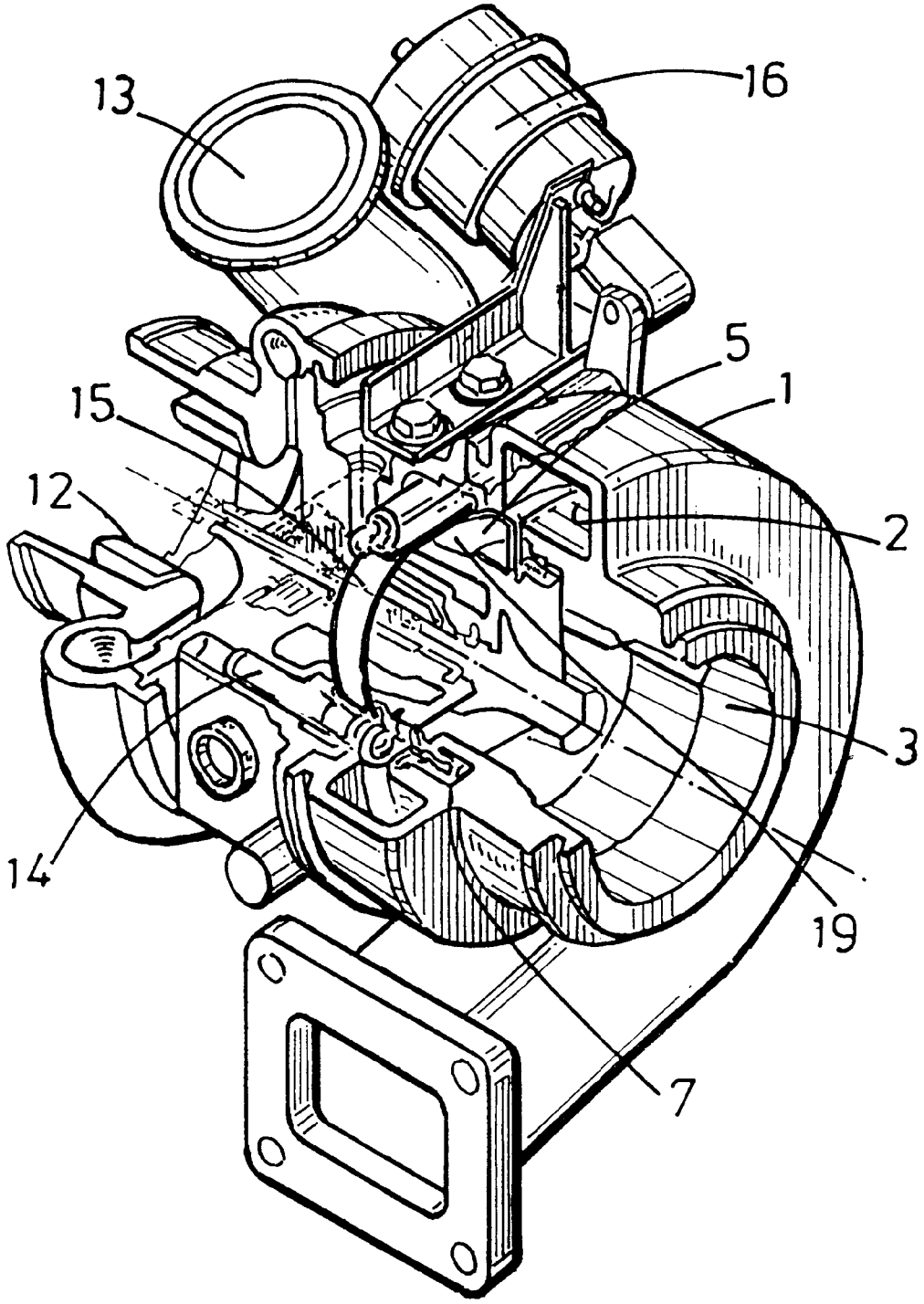
FIG. 1 is a schematic partially cut-away perspective view of a turbocharger embodying the present invention.

Referring to the drawings, the illustrated variable geometry turbine comprises a turbine housing 1 defining a volute or inlet chamber 2 to which gas from an internal combustion engine (not shown) is delivered. The exhaust gas flows from the inlet chamber 2 to an outlet passage 3 via an annular inlet passage 4 defined on the opposite side the face of a movable annular wall member or nozzle ring 5 and on the opposite side by an annular shroud 6 which covers the opening of an annular recess 7 defined in the facing wall of the housing 1.

The nozzle ring 5 supports an array of circumferencially spaced vanes 8 each of which extends across the inlet passage, through a suitably configured slot in the shroud 6, and into the recess 7.

Figure 2:
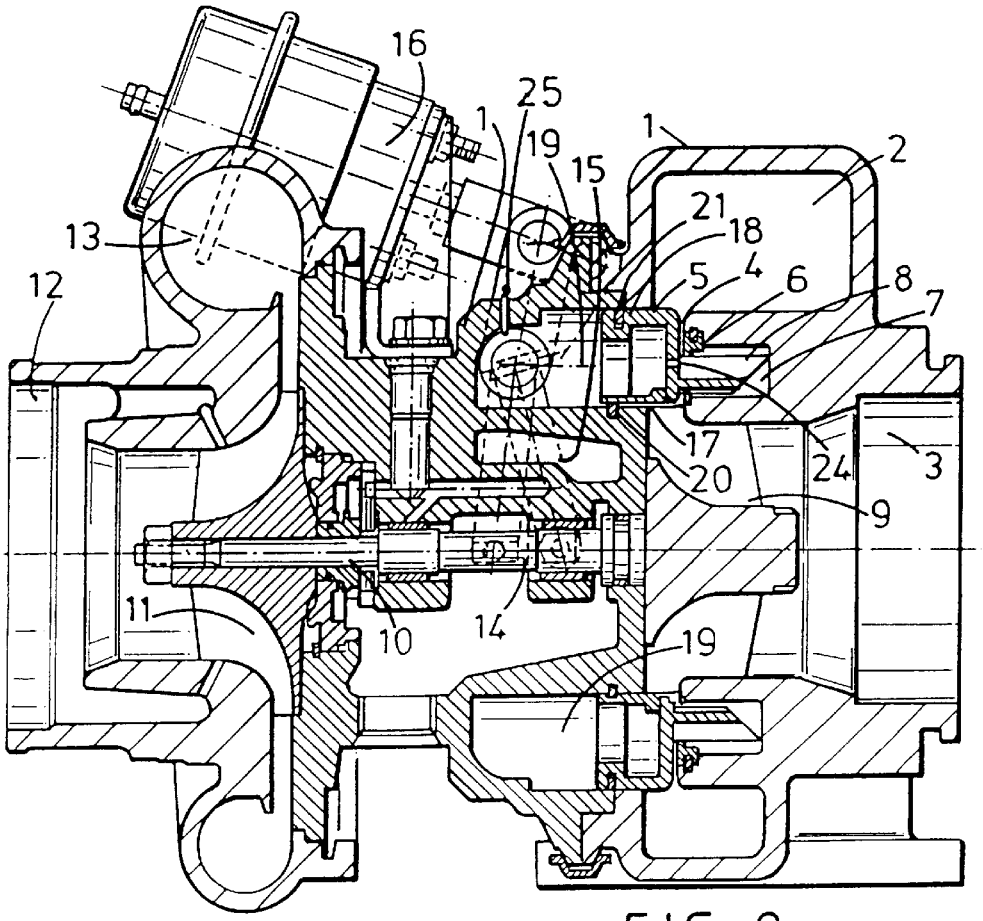
FIG. 2 is an axial section through the turbocharger of FIG. 1, showing a typical location of a pressure tapping and pressure transducer.
Figure 3:
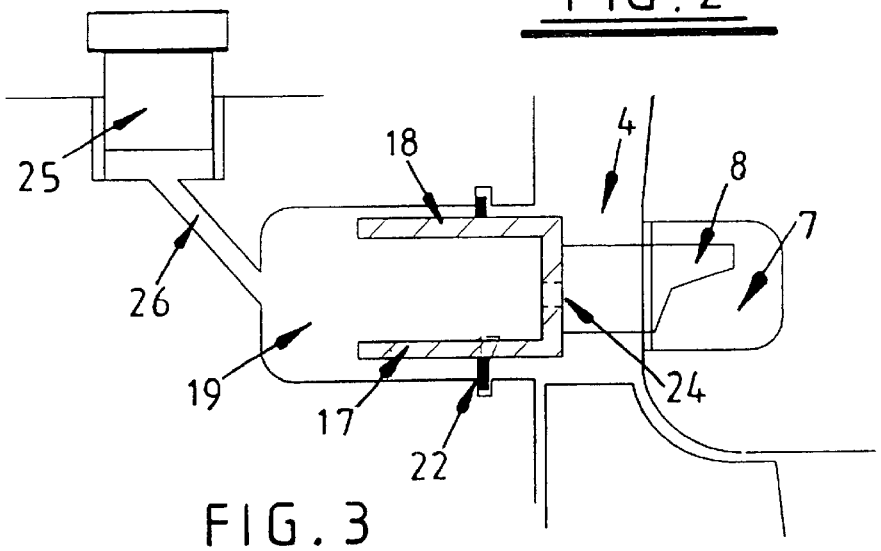
FIG. 3 shows a simplified part of the structure illustrated in FIG. 2 to a larger scale and after displacement of a nozzle ring incorporated in that structure.

Gas flowing from the inlet chamber 2 to the outlet passage 3 passes over a turbine wheel 9 and as a result torque is applied to a turbocharger shaft 10 which drives a compressor wheel 11. Rotation of the compressor wheel 11 pressurizes ambient air present in an air inlet 12 and delivers, the pressurized air to an air outlet or volute 13 from which it is fed to an internal combustion engine (not shown). The speed of the turbine wheel 9 is dependent upon the velocity and density of the gas passing through the annular inlet passage 4. For a fixed rate of flow of gas, the gas velocity is a function of the width of the inlet passage 4, which can be adjusted by controlling the axial position of the nozzle ring 5. In the drawings, FIG. 2 shows the annular inlet passage closed down to a minimum width, whereas in FIG. 3 the inlet passage is shown fully open. As the width of the inlet passage 4 is reduced the velocity of the gas passing through it increases.

The nozzle ring 5 is mounted on two axially extending pins 14 arranged on opposite sides of the turbine, the position of the pins 14 being controlled by a stirrup member 15 which is linked to a pneumatically operated actuator 16. Further details of the mechanical structure of the actuator system will not be discussed here as they are not relevant to the subject of the present invention, and the illustrated actuator system is only one of many conventional actuator systems that could be used in embodiments of the invention, for example the system described in U.S. Pat. No. 5,055,880.

The nozzle ring 5 has axially extending inner and outer annular flanges 17 and 18 respectively which extend into an annular recess 19, provided in the turbine housing. Inner and outer sealing rings 20 and 21 respectively are provided to seal the nozzle ring 5 with respect to inner and outer annular surfaces of the annular recess 19 whilst allowing the nozzle ring 5 to slide within the annular recess 19. The inner sealing ring 20 is supported within an annular groove 22 formed in the inner surface of the recess 19 and bears against the inner annular flange 17 of the nozzle ring 5, whereas the outer sealing ring 21 is supported within an annular groove 23 provided within the annular flange 18 of the nozzle ring 5 and bears against the radially outer most internal surface of the recess 19. It will be appreciated that the inner and/or outer sealing rings 20, 21 could be mounted in an annular groove in the flange 17 and/or body 1 rather than as shown. Such an arrangement might make assembly easier.

The nozzle ring 5 is provided with a number of apertures 24 disposed between adjacent pairs of vanes 8 by means of which the face of the nozzle ring 5 which defines one side of the angular inlet passage 4 is in fluid communication with the recess 19, which is otherwise sealed off from the inlet passage 4 by the sealing rings 20 and 21.

When in use with exhaust gas passing through the inlet passage 4, static pressure will be applied to the face of the nozzle ring 5, tending to force the nozzle ring 5 into the recess 19. The effect of this pressure must be overcome by the actuating mechanism if the position of the nozzle ring 5 is to be accurately controlled Moving the nozzle ring 5 closer to the facing wall of the housing defined in part by the shroud 6 reduces the width of the annular passage 4. This increases the speed of the air flowing through the annular inlet passage 4, and tends to increase the pressure gradient across the nozzle ring 5 from its upstream perifery as explained in U.S. Pat. No. 5,522,697. As a result, the load applied to the face of the nozzle ring 5 increases. However, the provision of the apertures 24 through the nozzle ring 5 ensures that the pressure in the recess 19 is not substantially different from the static pressure applied to the face of the nozzle member 5 at the location of the apertures 24, and thus the provision of the apertures 24 ensures that the resultant load on the nozzle ring is significantly reduced.

The components described above with reference to FIGS. 2 and 3 are also described in U.S. Pat. No. 5,522,697 which is concerned with the minimization of load of the nozzle ring 5. The illustrated structure is modified however as compared with the structure described in European Patent Specification No. 0 654 587 by the incorporation of pressure sensor 25, the sensor communicating with a bore 26 which extends through the housing wall into the recess 19. The pressure sensor 25 produces an output representative of the pressure within the cavity 19.

Figure 4:
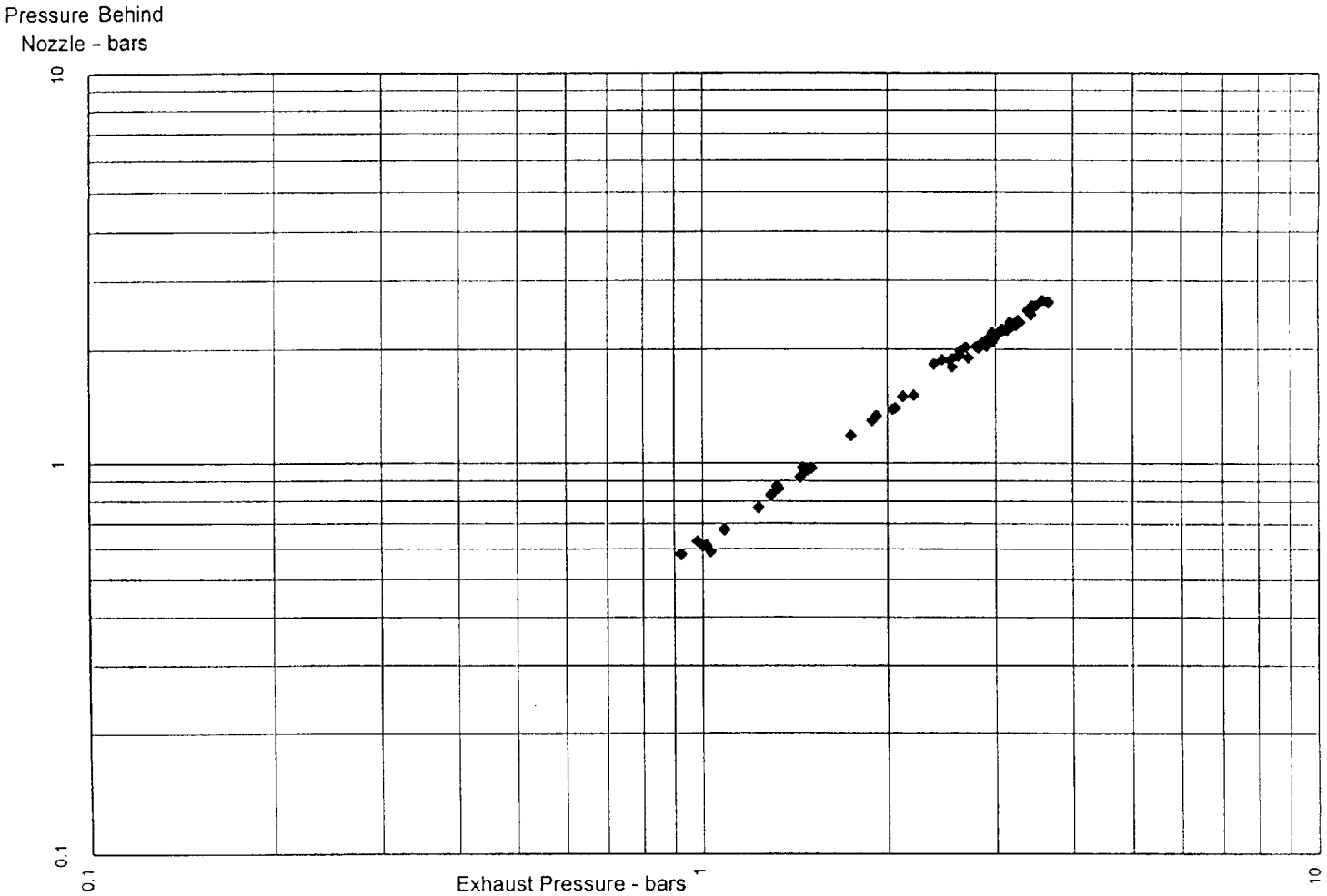
FIG. 4 is a graph illustrating the relationship between pressure behind the nozzle ring in the turbine illustrated in FIGS. 1 to 3 and the mean pressure in the exhaust manifold of an engine connected to that turbine.

FIG. 4 plots the relationship between the pressure in the recess 19 behind the nozzle ring and the mean pressure in the exhaust gas manifold of an engine connected to the exhaust inlet of the illustrated structure. It will be noted, that although the pressure behind the nozzle ring is lower than the mean exhaust manifold pressure, there is a well defined relationship between the two pressures and thus a measurement of the pressure in the recess 19 enables calculation of an accurate measure of the mean exhaust manifold pressure. The sensor 25 is located in a position where it is protected from the relatively more extreme conditions existing in the exhaust manifold itself. The pressure sensor 25 is in intimate contact with the housing 1 and thus is cooled by the water circulation system of the turbine. Furthermore, as the recess 19 communicates with the inlet passage 4 only through the relatively narrow openings 24 the pressure within the recess 19 is to a large degree smoothed as compared with the large fluctuations in pressure which appear in the exhaust manifold. This makes the derivation of a measure of the mean manifold pressure easier. Finally, the velocity of exhaust gas entering the recess 19 is relatively low and as a result impurities carried in the gas tend to be deposited in the recess 19 and do not build up on the pressure sensor 25.

Given the relatively undemanding environment in which the sensor 25 must operate, a conventional commercially available pressure sensor can be used. Thus the problems of deriving an accurate measure of the mean exhaust manifold pressure which arise if pressure measurements are made directly within the exhaust gas manifold are overcome. It is therefore possible to use the output of the pressure sensor 25 to control the operation of the nozzle ring actuator 16 and thereby to achieve the enhanced performance which it is known can be obtained by modulating the geometry of the exhaust turbine in dependence upon the mean exhaust manifold pressure.

Alternative sealing means to these illustrated may be provided to seal the nozzle ring within the cavity. More than one seal may be provided between either the inner or outer peripheries of the nozzle ring 5 and the housing 1. A seal maybe provided on only the downstream side of the nozzle ring, that is adjacent the flange 17, providing the required stable pressure related to engine exhaust pressure can be maintained in the recess 19. The seals may be for example piston ring type seals of rectangular cross section with a gap in their circumference so that they can expand or contract into a suitable groove. Alternatively, the seals may be double wound seals forming a spring-like structure. The seals may be inspiring so as to be suitable for location in a groove in an inwardly facing surface, or outspringing so as to be suitable for location in a groove in an outwardly facing surface.

What is claimed is:

1. A variable geometry turbine for an internal combustion engine, the turbine comprising: a housing having an annular exhaust gas inlet passage defined between walls of the housing; a nozzle ring which is displaceable across the inlet passage; means for controlling the displacement of the nozzle ring in response to variations in at least one sensed parameter, the nozzle ring extending into an annular recess defined by the housing in one side wall of the inlet passage to form a chamber; means for establishing fluid communication between the inlet passage and the chamber; a pressure sensor, and; means connected to and positioned to communicate the pressure within the chamber defined between the housing and the nozzle ring to the pressure sensor, the control means being responsive to variations in the sensed pressure.

2. A turbine according to claim 1, wherein the nozzle ring is of U-shaped radial section and has a radial wall facing the inlet passage and two axial flanges extending into the recess from radially opposite edges of the radial wall, seals are provided between each of the axial flanges and facing walls of the recess, and at least one aperture is provided in the radial wall to interconnect the inlet passage and the chamber.

* * * * *